United States Patent [19]

Fujikawa et al.

[11] 4,329,948

[45] May 18, 1982

[54] MULTIPLE PORT CYLINDER FOR CRANKCHAMBER PRECOMPRESSION TYPE TWO STROKE ENGINES

[75] Inventors: Tetsuzo Fujikawa; Yasuhiro Seto, both of Kobe; Masaru Yamamoto, Hyogo; Ichiro Tanaka, Akashi, all of Japan

[73] Assignee: Kawasaki Jukogyo Kabushiki Kaisha, Hyogo, Japan

[21] Appl. No.: 134,344

[22] Filed: Mar. 26, 1980

[30] Foreign Application Priority Data

Mar. 30, 1979 [JP] Japan ..... 54-42820[U]

[51] Int. Cl.[3] ..... F02B 33/04

[52] U.S. Cl. ..... 123/73 AA; 123/65 P

[58] Field of Search ..... 123/73 AA, 65 P, 65 PD

[56] References Cited

FOREIGN PATENT DOCUMENTS 93860 12/1938 Sweden ..... 123/73 AA

*Primary Examiner*—Wendell E. Burns

*Attorney, Agent, or Firm*—Edward J. Kondracki

[57] ABSTRACT

A cylinder for crankchamber precompression type two stroke engines includes three pairs of main scavenging ports which are symmetrical with respect to a longitudinal plane passing through the centers of the intake and exhaust ports and containing the longitudinal center line of the cylinder. A pair of auxiliary scavenging ports are provided at the opposite sides of the longitudinal plane in such a manner that in a horizontal cross-section the flows from the auxiliary ports do not intersect with the flows from the main ports. Further, the auxiliary scavenging ports are directed further upwardly than the main ports.

5 Claims, 3 Drawing Figures

MULTIPLE PORT CYLINDER FOR CRANKCHAMBER PRECOMPRESSION TYPE TWO STROKE ENGINES

The present invention relates to two stroke engines, and more particularly to multiple port cylinder structures for crankchamber precompression type two stroke engines.

Conventionally, crankchamber precompression type two stroke engines have intake ports adapted to be opened to crankchambers when pistons are moved upwards. At the opposite sides of the intake ports, there are formed exhaust ports which are adapted to be opened to combustion chambers when the pistons are moved downwards. During the downward movements of the pistons, the intake ports are closed by the skirt portions of the pistons so that the combustible mixtures in the crankchambers are compressed by the descending piston. The mixtures thus compressed in the crankchambers are introduced into the combustion chambers through scavenging passages and scavenging ports which are also formed in the cylinders.

In a conventional cylinder for two stroke engines, a plurality of scavenging ports are provided at diametrically opposite side wall portions of the cylinder in such a manner that the exhaust port is located between the opposed scavenging ports. In conventional arrangements, on each side wall portion of the cylinder, a pair of scavenging ports are formed in circumferentially adjacent positions. An auxiliary scavenging port may additionally be provided in the cylinder wall opposite to the exhaust port in order to expel the combustion gas in the central portion of the combustion chamber.

In this type of cylinder having the auxiliary scavenging port, several disadvantages have been experienced. For example, the scavenging flow from the auxiliary port is apt to pass across the combustion chamber to the exhaust port so that fuel constituents are lost without being burnt. Further, the scavenging flow from the auxiliary port may interfere with the flow from the main scavenging ports to thereby diminish the effects of the scavenging flows. It should further be noted that, as the results of the interference between the main and auxiliary scavenging flows, the combustion gas which has been concentrated in the central portion of the combustion chamber is dissipated and a part of such dissipated combustion gas may not be expelled from the combustion chamber.

There are further disadvantages in the conventional scavenging port arrangements wherein two scavenging ports are located in each side of the exhaust port. In the conventional arrangement, if the areas of the scavenging ports are widened for the purpose of increasing the scavenging flow, the scavenging gas through the ports closer to the exhaust port may be deflected toward the exhaust port as soon as it leaves the scavenging ports as long as the scavenging ports are not changed. If the directions of the scavenging ports closer to the exhaust port are changed from those in conventional designas toward the cylinder wall opposite to the exhaust port, there will be a possibility that the scavenging flows from these scavenging ports interfere with the flows from the other scavenging ports which are farther from the exhaust port. This will result in turbulence in the scavenging flows and the combustion gas will be dissipated by the turbulent scavenging flows.

It is therefore an object of the present invention to provide a scavenging port arrangement for two stroke engine cylinders in which the amount of scavenging flow can be increased without having any accompanying problems.

Another object of the present invention is to provide a two stroke engine cylinder with a scavenging port arrangement in which auxiliary scavenging flow does not interfere with main scavenging flow.

A further object of the present invention is to provide a scavenging port arrangement for a two stroke engine cylinder in which the combustion gas is expelled from the combustion chamber without being dissipated by the scavenging flow.

According to the present invention, the above and other objects can be accomplished by a multiple port cylinder for a crankchamber precompression type two stroke engine which includes a cylinder wall provided with intake port means and exhaust port means located at diametrically opposite portions along a longitudinal plane containing a longitudinal center line of the cylinder, a first group of three main scavenging ports formed in the cylinder wall at one side of the longitudinal plane, a second group of three main scavenging ports formed in the cylinder wall and symmetrical to the ports in the first group with respect to the longitudinal plane, a pair of auxiliary scavenging ports formed in the cylinder wall at a side opposite to the exhaust port means and symmetrical with each other with respect to the longitudinal plane, said auxiliary scavenging ports being oriented in a cross-section perpendicular to the longitudinal center line so that scavenging flows therefrom do not substantially intersect with scavenging flows from the main scavenging ports at the longitudinal plane, said auxiliary scavenging ports being oriented further upwardly than the main scavenging ports.

According to the features of the present invention, three main scavenging ports are provided at each side of the exhaust port means so that it is possible to provide the main scavenging port nearest to the exhaust port means with a limited width and it is also possible to have the nearest scavenging port more inclined with respect to the longitudinal plane than the other main scavenging ports in a direction opposite to the exhaust port means to thereby decrease the amount of scavenging flow which may be passed to the exhaust port means without serving to expel the combustion gas. Thus, the main scavenging port arrangement in accordance with the present invention is advantageous over the conventional arrangement in that the main scavenging flow can be increased without any accompanying problem. Further, in accordance with the present invention, there is provided a pair of auxiliary scavenging ports which are symmetrical with each other with respect to the longitudinal plane and oriented in such a manner that the scavenging flows through the auxiliary ports do not intersect with the scavenging flows through the main scavenging ports at the longitudinal plane and that the auxiliary ports are oriented upwardly than the main ports. Thus, the auxiliary scavenging flows function to force the main scavenging flows which have ascended to the center portion of the combustion chamber toward the center of the combustion chamber whereby the combustion gas which has been concentrated in the central portion of the combustion chamber is expelled from the combustion chamber without being dissipated by the scavenging flows.

The above and other objects and features of the present invention will become apparent from the following descriptions of preferred embodiments taking reference to the accompanying drawings, in which.

Figure 1:
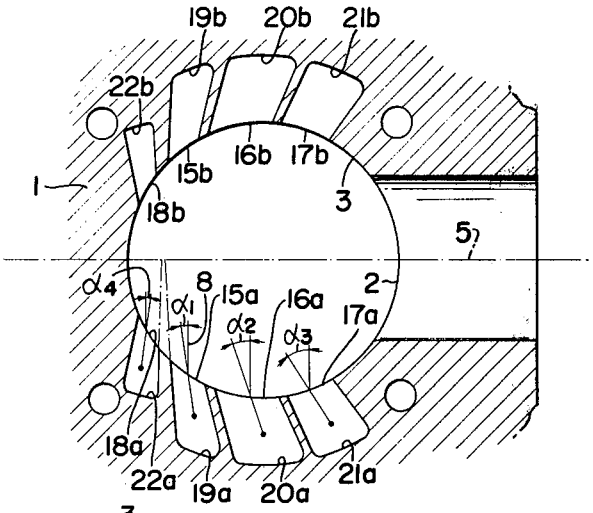
FIG. 1 is a horizontal sectional view of a two stroke engine cylinder in accordance with one embodiment of the present invention.
Figure 2:
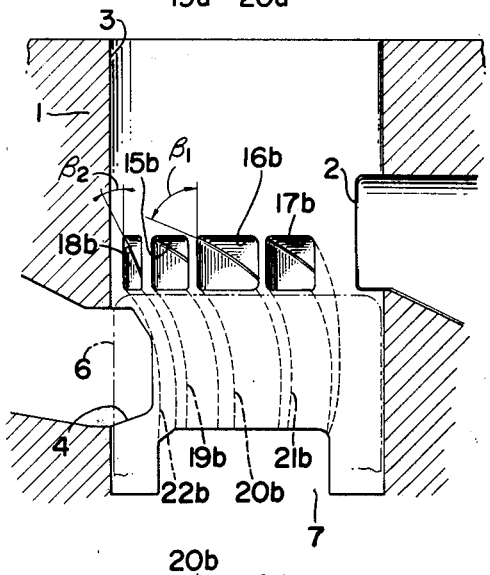
FIG. 2 is a vertical section of the cylinder taken along the longitudinal symmetrical plane.

Referring now to the drawings, particularly to FIGS. 1 and 2, there is shown a cylinder 1 for a two stroke engine which has a cylinder wall 3 formed with an exhaust port 2 and an intake port 4 located at diametrically opposite positions. The ports 2 and 4 have centers which are located on a longitudinal plane 5 passing through the longitudinal center line of the cylinder 1. It will thus be understood that the exhaust and intake ports 2 and 4 are symmetrical with respect to the longitudinal plane 5. A piston 6 is disposed in the cylinder 1 for reciprocating movement as shown by a phantom line in FIG. 2 and a crankchamber 7 is defined beneath the piston 6. As well known in the art, the intake port 4 is opened to the crankchamber 7 when the piston 6 is moved upwardly to introduce combustible mixture of air and fuel.

At one side of the longitudinal plane 5, the cylinder wall 3 is formed with three main scavenging ports 15*a*, 16*a* and 17*a*. On the other side, there are also formed three main scavenging ports 15*b*, 16*b* and 17*b* which are symmetrical to the ports 15*a*, 16*a* and 17*a*, respectively, with respect to the longitudinal plane 5. As shown in FIGS. 1 and 2, the main scavenging ports 15*a*, 16*a* and 17*a* are in communication with the crankchamber 7 respectively through main scavenging passages 19*a*, 20*a* and 21*a*. Similarly, the ports 15*b*, 16*b* and 17*b* are in communication with the crankchamber 7 respectively through main scavenging passages 19*b*, 20*b* and 21*b*.

Referring to FIG. 1 which shows a horizontal section of the cylinder 1, it will be noted that the port 15*a* is generally oriented in the direction opposite to the exhaust port 2 by an angle $\alpha_1$ with respect to a plane 8 perpendicular to the plane 5. The port 16*a* is generally oriented in the same direction by an angle $\alpha_2$ which is larger than the angle $\alpha_1$. The port 17*a* which is nearest to the exhaust port 2 is generally oriented with respect to a plane perpendicular to the plane 5 in the direction opposite to the exhaust port 2 by an angle $\alpha_3$ which is greater than the angles $\alpha_1$ and $\alpha_2$. The ports 15*b*, 16*b* and 17*b* are oriented in the same way as the ports 15*a*, 16*a* and 17*a*, respectively.

Referring to FIG. 2, it will be noted that the ports 15*b*, 16*b* and 17*b* are slightly upwardly directed to make angles $\beta_1$ which are smaller than 90° with respect to a vertical line. It should of course be understood that the ports 15*a*, 16*a* and 17*a* are directed obliquely upwardly as the ports 15*b*, 16*b* and 17*b* are. As well known in the art, the main scavenging ports have upper edges which are in a lower level than the upper edge of the exhaust port 2 so that the scavenging ports are opened during a downward movement of the piston 6 after the exhaust port 2 is opened.

As shown in FIG. 1, the cylinder 1 is further formed with a pair of auxiliary scavenging ports 18*a* and 18*b* which are at the opposite sides of the longitudinal plane 5 and symmetrical with each other with respect to the longitudinal plane 5. The auxiliary scavenging ports 18*a* and 18*b* are in communication with the crankchamber 7 through auxiliary scavenging passages 22*a* and 22*b*, respectively.

In FIG. 1, it will be noted that the direction of the port 18*a* is inclined with respect to a plane perpendicular to the plane 5 by an angle $\alpha_4$ toward the exhaust port 2. The angle $\alpha_4$ is determined in such a way that an extension of the peripheral side of the port 18*a* adjacent to the port 15*a* does not intersect the extension of the adjacent peripheral side of the port 15*a* at the longitudinal plane 5 as shown by phantom lines in FIG. 1. In other words, the scavenging flow through the port 18*a* does not substantially intersect with the scavenging flow through the port 15*a* at the plane 5 in a horizontal section. The auxiliary scavenging port 18*b* is oriented in the same manner as the port 18*a*.

As shown in FIG. 2, the auxiliary scavenging port 18*b* is upwardly inclined to make an angle $\beta_2$, with respect to a vertical line, the angle $\beta_2$ being smaller than the angle $\beta_1$. In other words, the auxiliary scavenging port 18*b* is inclined with respect to a horizontal plane more upwardly than the main scavenging ports are. The other auxiliary scavenging port 18*a* is also upwardly inclined in the same manner as in the port 18*b*.

In the port arrangement as described, the scavenging mixture flows from the main scavenging ports do not intersect with the flows from the auxiliary ports at the longitudinal plane 5 so that the main scavenging flows are not made turbulent by the auxiliary scavenging flows. The scavenging flows from the main scavenging ports at the opposite sides of the longitudinal plane 5 flow substantially along the wall surface 3 and merge at the plane 5 and from this portion the merged flow proceeds upwardly. Further, the auxiliary flows go ahead of the main flows and further upwards than the main flows do and function to force the main scavenging flows toward the center of the combustion chamber when they have come up to the central portion of the combustion chamber. As the result, the combustion gas which has been concentrated in the central portion of the combustion chamber is expelled through the exhaust port 2 by the scavenging mixture flows without being dissipated. Further, the three main port arrangement is advantageous in that the main scavenging ports 17*a* and 17*b* nearest to the exhaust port 2 can be directed farther away from the exhaust port 2 so that it is possible to decrease the amount of scavenging flow which is passed directly to the exhaust port 2 without performing its purpose.

Figure 3:
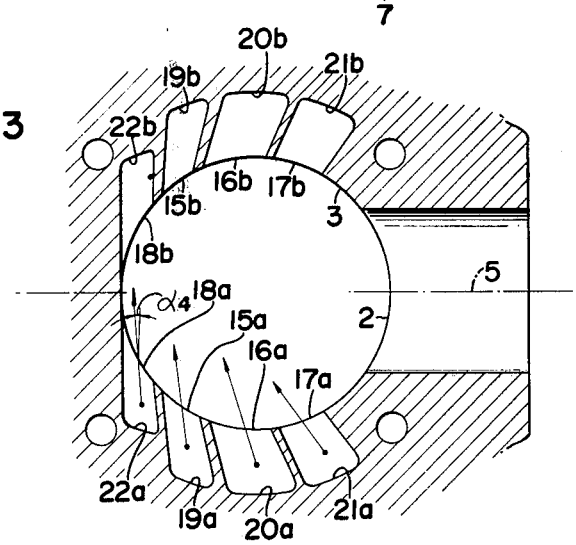
FIG. 3 is a horizontal sectional view showing another embodiment of the present invention.

The angles which determine the directions of the scavenging ports may be properly determined. The main scavenging ports 15*a*, 15*b*; 16*a*, 16*b*; and 17*a*, 17*b* are so directed that the angles $\alpha_1$, $\alpha_2$ and $\alpha_3$ increase in this order whereby the main scavenging flows are directed generally along the wall surface 3 of the cylinder 1. The angle $\alpha_4$ may be between +30° and −30°. In the embodiment shown in FIGS. 1 and 2, the angle $\alpha_4$ is approximately +15°. In FIG. 3, there is shown another embodiment in which the angle $\alpha_4$ is −10°. In other respects, the arrangement in FIG. 3 is identical with the arrangement in FIGS. 1 and 2 so that corresponding parts are designated by the same reference characters.

The angle $\beta_1$ for the main scavenging ports may be approximately 80° whereas the angle $\beta_2$ may be approximately 45° so that the auxiliary scavenging flows are directed further upwards than the main scavenging flows.

The invention has thus been shown and described with reference to specific embodiments, however, it should be noted that the invention is in no way limited to the details of the illustrated arrangements but changes and modifications may be made without departing from the scope of the appended claims.

We claim:

1. A multiple port cylinder for a crankchamber precompression type two stroke engine which includes a cylinder wall provided with intake port means and exhaust port means located at diametrically opposite portions along a longitudinal plane containing a longitudinal center line of the cylinder, a first group of three main scavenging ports formed in the cylinder wall at one side of the longitudinal plane, a second group of three main scavenging ports formed in the cylinder wall and symmetrical to the ports in the first group with respect to the longitudinal plane, a pair of auxiliary scavenging ports formed in the cylinder wall at a side opposite to the exhaust port means and symmetrical with each other with respect to the longitudinal plane, said main and auxiliary scavenging ports being connected respectively with mutually separated main and auxiliary scavenging passages which are oriented so that in a cross-section perpendicular to the longitudinal center line scavenging flows from the auxiliary scavenging ports do not substantially intersect with scavenging flows from the main scavenging ports before they reach the longitudinal plane, said auxiliary scavenging passages being oriented in the vicinity of the auxiliary scavenging ports further upwardly than the main scavenging passages.

2. A cylinder in accordance with claim 1 in which the main scavenging port nearest to the exhaust port means in each side of the longitudinal plane is directed farther opposite to the exhaust port means as compared with other two main scavenging ports in the same side of the longitudinal plane.

3. A cylinder in accordance with claim 1 in which each of said auxiliary scavenging ports is directed toward the exhaust port means, in a cross-section perpendicular to the longitudinal center line, with respect to a plane perpendicular to the said longitudinal plane.

4. A cylinder in accordance with claim 1 in which each of said auxiliary scavenging ports is directed opposite to the exhaust port means, in a cross-section perpendicular to the longitudinal center line, with respect to a plane perpendicular to the longitudinal plane.

5. A cylinder in accordance with claim 1 in which each of said auxiliary scavenging ports is inclined, in a cross-section perpendicular to the longitudinal center line, with respect to a plane perpendicular to the longitudinal plane by an angle between 30° toward and 30° away from the exhaust port means.

* * * * *